United States Patent [19]

Vikre

[11] 4,044,858

[45] Aug. 30, 1977

[54] MAINTENANCE DEVICE FOR USE UNDERNEATH DECK STRUCTURES

[75] Inventor: Lauritz Vikre, Bergen, Norway

[73] Assignee: Sverre Munck A/S, Bergen, Norway

[21] Appl. No.: 634,117

[22] Filed: Nov. 21, 1975

[30] Foreign Application Priority Data

Nov. 22, 1974 Norway ..... 744217
Nov. 17, 1975 Norway ..... 753855

[51] Int. Cl.[2] ..... E04G 3/10; E04G 3/14
[52] U.S. Cl. ..... 182/82; 182/150
[58] Field of Search ..... 182/63, 150, 82, 36; 214/151; 212/61, 65, 69, 48

[56] References Cited

U.S. PATENT DOCUMENTS

| | | | |
|---|---|---|---|
| 2,669,490 | 2/1954 | Kaufman | 182/63 |
| 3,076,522 | 2/1963 | Goodell | 182/150 |
| 3,183,997 | 5/1965 | Kleiss | 182/150 |
| 3,237,718 | 3/1966 | Pearson | 182/36 |
| 3,550,723 | 12/1970 | Gentry | 182/150 |
| 3,608,669 | 9/1971 | Lindsay | 182/63 |
| 3,708,038 | 1/1973 | Ewing | 182/150 |

*Primary Examiner*—Reinaldo P. Machado
*Attorney, Agent, or Firm*—Larson, Taylor and Hinds

[57] ABSTRACT

A maintenance device for use underneath a deck has an elongated arm connectable to the deck and extending beneath the deck and movable about a vertical axis. A platform mounted on the arm is movable along the arm and may be further movable relative to the arm such as by being rotatable about a second vertical axis or movable vertically relative to the arm. A deck including such a maintenance device may have a plurality of connecting points spaced about the deck such that the arm, by being connected to different ones of said connecting points can reach the entire area beneath the deck.

15 Claims, 4 Drawing Figures

MAINTENANCE DEVICE FOR USE UNDERNEATH DECK STRUCTURES

The invention concerns a maintenance device for use underneath deck structures, particularly for use on oil drilling and production platforms and the like.

So-called off-shore oil platforms are usually equipped with a large deck structure which is situated high above the sea surface when the platform is in use at sea. Under such conditions, it is very difficult on most platforms to gain access to every spot underneath the platform deck for performing necessary control, painting and other maintenance work. This may require that the oil platform must be taken out of use whenever such work is to be done, involving high costs due among other things to time loss. For production platforms this problem is even greater because these normally rest on the sea floor without being movable for a number of years. Here it is necessary to use scaffolding or the like of a more or less fixed nature, involving high costs and certain elements of danger.

The purpose of the invention is to remedy all the above-mentioned drawbacks associated with control and maintenance underneath platform decks. This is obtained according to the invention with a device whose characteristic features appear from the following claims.

For better understanding of the invention, it is described below in connection with the examplified embodiment shown in the drawings.

Figure 1:
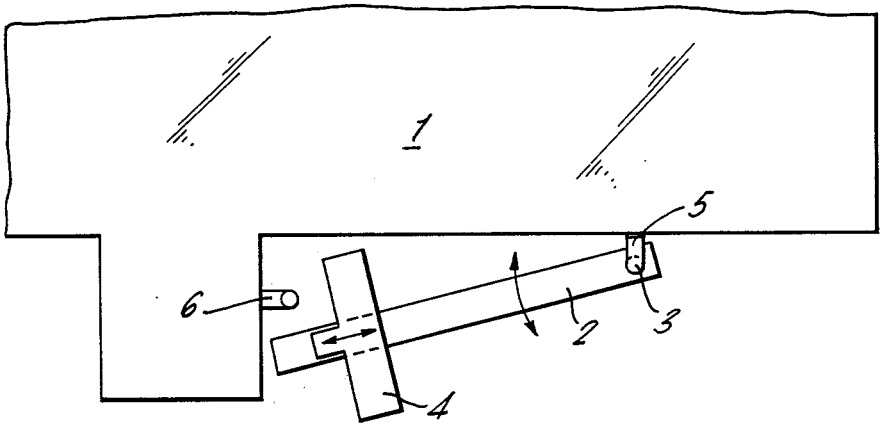
FIG. 1 shows a top view of parts of a platform deck equipped with a device according to the invention.
Figure 2:
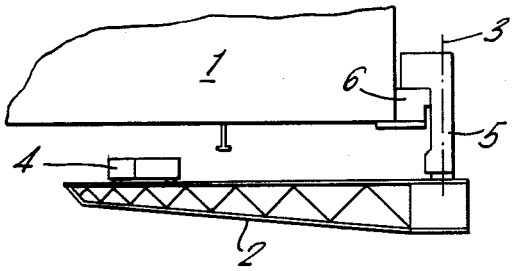
FIG. 2 shows the platform deck and the device of FIG. 1 seen from the side.

The platform deck 1 shown on FIGS. 1 and 2 is equipped with supporting devices or brackets 6 which are placed at certain locations on the side of the platform deck. A pivotable arm 2 may be attached to these brackets. The arm 2 is equipped with a platform or carriage 4 which can move along the arm in both directions as suggested in FIG. 1. The carriage 4 moves on wheels or similar antifriction means, and it is guided in such a way that it cannot tip or move off the arm. The arm 2 is movably supported on an intermediate connecting member 5 and is pivotable about a vertical axis 3. The intermediate connecting member 5 is in turn fixed to the bracket 6, and these two parts co-operate so that they are held in interlocked engagement by the weight of the arm.

The arm 2 can be pivoted in both directions as shown by the arrow in FIG. 1, and the carriage 4 can thereby be brought to cover a sector of a circle underneath the platform deck, the circle having a radius approximately equal to the length of the arm. The carriage 4 has wings extending out over the sides of the arm in order to facilitate access to the back side of downwardly extending columns or the like limiting the swinging motion of the arm.

The intermediate connecting member 5 and the arm 2, possibly with the carriage 4, can be lifted as a unit by means for instance of a crane and thereby be detached from the bracket 6. Thereafter, the arm can easily be transported to the place on the platform deck needing maintenance and be lowered in place on the nearest bracket 6. The mutual distance between the bracket 6, their location and the length of the arm are co-ordinated so that the carriage 4 can reach any desirable point underneath the platform deck.

Since all parts of the arm with the carriage and the supporting device are located on the side of or underneath the platform deck, the carriage can work without being disturbed by or interfering with the activity on deck. Maintenance work can therefore be performed from the carriage 4 at any time, even under bad weather conditions.

Figure 3:
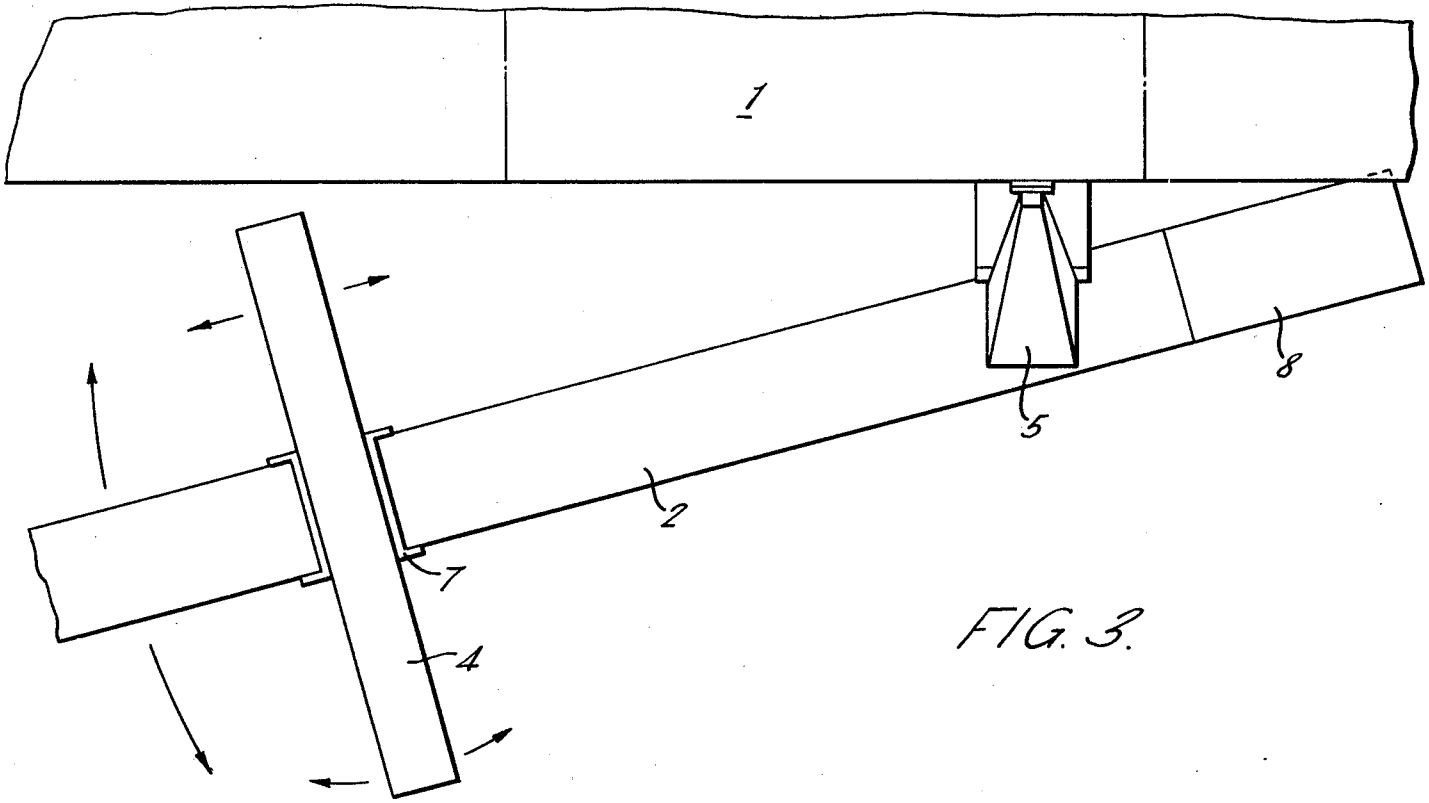
FIG. 3 shows an especially favourable embodiment of the invention seen from above.
Figure 4:
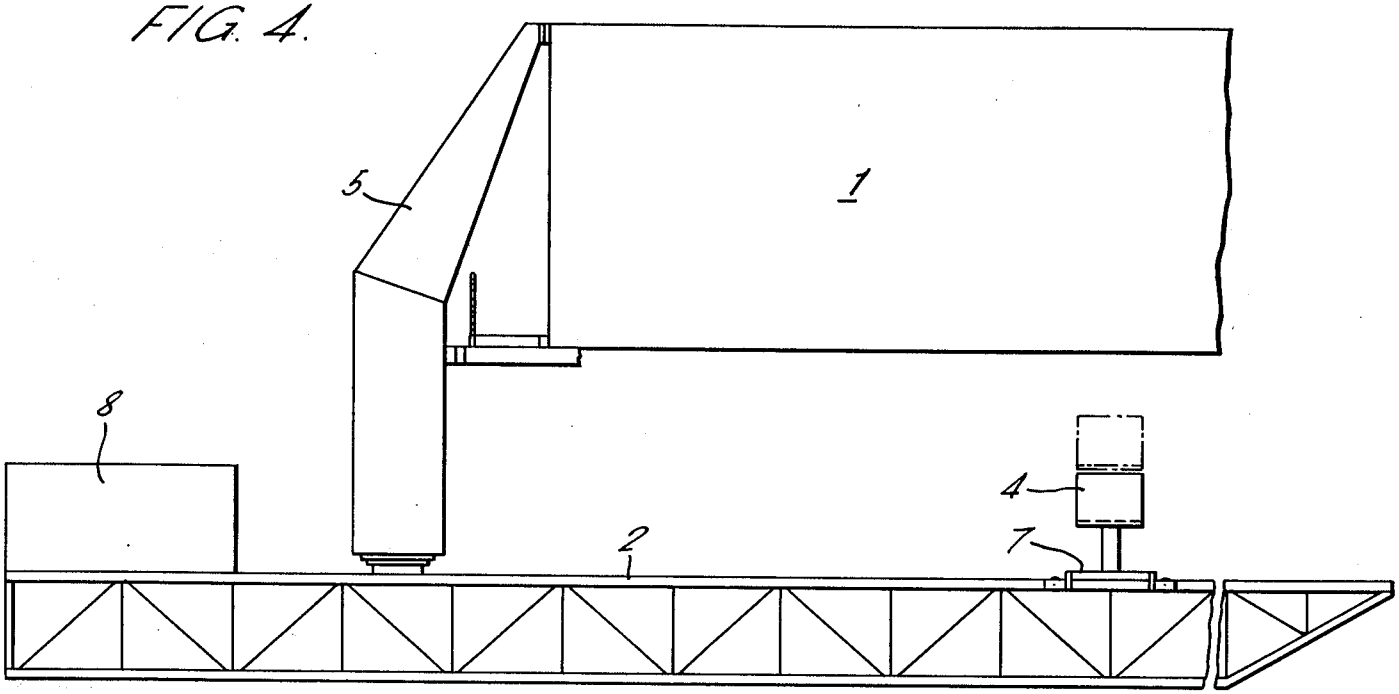
FIG. 4 shows the embodiment of FIG. 3 seen from beside.

FIGS. 3 and 4 show an especially advantageous embodiment of the invention. In this embodiment, the platform 4 is arranged to be raised and lowered on a chassis 7. The platform 4 can also be pivoted 360° with respect to the chassis 7 and the arm 2. This makes it easier to gain access to the back side of columns, downwardly extending tanks, etc. underneath the deck and permits inspection and maintenance of large vertical surfaces.

FIG. 4 also shows a counterweight 8 arranged at that end of the arm 2 which is situated on the opposite side of the bracket 6 with respect to the platform 4. The purpose of the counterweight is to reduce bending moment loading of the supporting system of the arm and can comprise energy sources, controlling devices etc. for operation of the maintenance device.

The invention can obviously be modified in a number of ways within the frame of the following claims. Thus, the supporting brackets can for instance be attached underneath the deck for better protection when not in use, and both the bracket and the intermediate connecting member can be given any suitable form. The intermediate connecting member can very well constitute a part of the arm, the pivotable connection then being arranged between the bracket and the intermediate connecting member.

I claim:

1. A maintenance device for use underneath a deck comprising:

an elongated arm which includes connecting means for connecting the arm to a deck with the arm extending beneath the deck and pivotable about a first vertical axis to swing around underneath the deck, and a platform mounted on the arm and movable longitudinally therealong beneath the deck, said platform further being rotatable about a second vertical axis, spaced from the first vertical axis, relative to said arm.

2. A maintenance device according to claim 1, said connecting means including means for detachably connecting the arm to the deck.

3. A maintenance device according to claim 2, said connecting means being connectable to the side of the deck.

4. A maintenance device according to claim 2, said connecting means including a pivotable connection of the arm to an intermediate connecting member which is in turn attached to the deck.

5. A maintenance device according to claim 4, wherein the intermediate connecting member is detachably connected to a supporting device which in turn is attached to the deck.

6. A maintenance device according to claim 5, wherein the supporting device is located on the side of the deck.

7. A maintenance device according to claim 2, the platform being vertically movable with respect to its arm.

8. A maintenance device according to claim 7, said platform including a chasis which is movable longitudinally on the arm, and the platform being movable vertically on the chasis.

9. A maintenance device according to claim 2, wherein the arm is equipped with a counterweight on the side of the first vertical pivot axis opposite from the platform.

10. A maintenance device according to claim 9, wherein the counterweight comprises means for energy supply, control and/or operation of the arm and/or the platform.

11. A deck mounted on columns and extending horizontally with a space therebeneath, a maintenance device connectable to the deck for movement about a vertical axis, said maintenance device including an arm extending underneath the deck such that as the arm pivots about said vertical axis, the arm swings beneath the deck, and a platform movable longitudinally along the arm beneath the deck, said platform also being movable vertically on the arm.

12. A deck according to claim 11, including connecting means for detachably connecting said arm to a plurality of points along the edge of the deck.

13. A deck according to claim 12, wherein the number of connecting means and the arrangement of the connecting means around the deck are such that for a given arm length, the entire area beneath the deck is swept over the hence reachable from the said platform.

14. A maintenance device for use underneath a deck comprising:

an elongated arm which includes connecting means for connecting the arm to a deck with the arm extending beneath the deck and pivotable about a vertical axis to swing around underneath the deck, and a platform mounted on the arm and movable longitudinally therealong beneath the deck, the platform being vertically movable with respect to its arm.

15. A deck mounted on columns and extending horizontally with a space therebeneath, a maintenance device connectable to the deck for movement about a vertical axis, said maintenance device including an arm extending underneath the deck such that as the arm pivots about said vertical axis, the arm swings beneath the deck, and a platform movable longitudinally along the arm beneath the deck, and further including connecting means for detachably connecting said arm to a plurality of points along the edge of the deck, said connecting means comprising a plurality of separate fixed brackets spaced apart around the circumference of the deck such that for a given arm length, the entire area beneath the deck is swept over and hence reachable from the said platform.

* * * * *